United States Patent [19]

Roberts et al.

[11] Patent Number: 4,874,152

[45] Date of Patent: Oct. 17, 1989

[54] CABLE GRIPPING BLOCK

[76] Inventors: Joseph E. Roberts, 318 Habersham St., Savannah, Ga. 31401; William A. Griswold, Jr., 111 Dove La., Savannah, Ga. 31406

[21] Appl. No.: 180,906

[22] Filed: Apr. 13, 1988

[51] Int. Cl.[4] ..... B66D 3/02

[52] U.S. Cl. ..... 254/264; 24/136 R; 254/384

[58] Field of Search ..... 254/264, 384, 402, 389, 254/245, 246, 259, 254; 24/115 ML, 132 WL, 136 R; 226/165, 166

[56] References Cited

U.S. PATENT DOCUMENTS 2,400,514 5/1946 Kantner ..... 24/136 R 4,569,507 2/1986 Robert ..... 254/246

FOREIGN PATENT DOCUMENTS 197808 8/1978 France ..... 24/136 R

*Primary Examiner*—Stuart S. Levy
*Assistant Examiner*—Katherine Matecki
*Attorney, Agent, or Firm*—J. B. Dickman, III

[57] ABSTRACT

A cable gripping block is provided with sectional cover plates for easy and quick removal, where the cover plates are secured to the cable gripping block by cylindrical tenons projecting from the cable gripping blocks, through cavities in the sectional cover plate. The tenons absorb any transverse forces generated by the clamping action of the cable gripping block.

5 Claims, 2 Drawing Sheets

CABLE GRIPPING BLOCK

BACKGROUND OF THE INVENTION

1. Field of the Invention

The present invention relates to a cable gripping block for linear winch applications of the type comprising a base with a pair of mirror image bearing blocks affixed to its top surface. The bearing blocks have matching inclined surfaces that increasingly converge at one end of the base. A pair of mating clamping blocks are mounted between the bearing blocks so that they are relatively movable longitudinally to clamp a cable or wire rope when moved in one direction and to release the cable or wire rope when moved in the opposite direction.

2. Description of the Prior Art

Cable gripping blocks are well known apparatus for clamping a cable, rope or bar for elongated traction or pulling, for example, moving a heavy load horizontally or vertically. The usual arrangement for cable gripping blocks can be used to change the tension on suspension bridge cables, overhead cables on tramways and any application where the free end of a cable is clamped for traction or pulling.

In the prior art, U.S. Pat. No. 4,569,507, a traction block is disclosed which includes an elongated frame having a U-shaped cross section having a flat web and two laterally spaced apart flanges perpendicular to the web, two clamping blocks of elongated shape, which are mounted for movement between the lateral flanges of the frame so that a relative longitude movement between each movable clamping block and the adjacent flange of the frame causes a transverse movement of the respective movable clamping block, and a flat cover plate parallel to the web of the frame and fixed removable thereto. The lateral flanges of the frame are provided with tenons which project from their end faces facing towards the cover plate and which are tightly fitted in corresponding cavities in the cover plate.

The tenons absorb transverse forces usually absorbed by the stud bolts. FIGS. 2 and 3 of U.S. Pat. No. 4,569,507 shows a hinged cover plate 8 with cavities 16 which correspond to tenons 15. There are a number of tenons on each bearing block to absorb the transverse forces exerted by the clamping blocks 5. To secure the cover plate 8 against the tenons, there are fastening bolts 12.

The tenons shown in FIGS. 3 and 4 are tapered, which is necessary since the cover plate is pivotally hinged to the frame. The use of tapered tenons and frusto conical cavities allow the arcuate movement of the cover plate to interfit the tenons in the cavities without binding. However, the tapered tenons and cavities develope a force equal to the formula, $$F_1=(\cos(L)/2$$

where $F_1$=the wedging force resisted by one lateral spaced apart flange

L=the angle of the tapered tenon and cavities measured parallel to the axis of the tenons and cavities.

This results in a very large and possibly dangerous force which must be resisted by the fastening bolts. The resulting force resisted by the fastening bolts can be calculated to about 28.8 tons, using the data from the patent and measuring the angle of the tenons and cavities. In order to compensate for these possible dangerous forces, the number, size and American Standard Testing Material No. (ASTM) must be calculated, for example using an ASTM number of A307 or A36, the number of bolts and size must correspond as follows: $\frac{3}{4}''$ diameter 8 bolts; $\frac{7}{8}''$ diameter—6 bolts, and 1" diameter—4 bolts. In other words, the larger the diameter, the fewer number of bolts required.

In addition to the high tension loads in the fastening bolts, the cover plate may be subjected to a bending force along with the tension load. This bending force is caused by the prying action of the tenons multiplied by the distance between the tenons and the fastening bolts. A secondary bending force may also be present in the cover plate acting between the fastening bolts.

SUMMARY OF THE INVENTION

The object of the present invention is to provide a cable gripping block with a cover plate that can be quickly and easily removed.

Another object of the present invention is to provide tenons to receive all of the transverse forces normally exerted on the fastening bolts.

Further it is an object of the present invention to provide hold down means for the cover plate.

In the embodiments of the present invention, the cover plate is comprised of two sections for easy removal. There is a lifting apparatus in one embodiment which lifts the cover plate sections vertically until clear of the tenons and then rotates it up and back into a storage position which is clear of the work area. The lifting apparatus multiplies the mechanical advantage of the operator's lifting force and additionally acts as a safety catch on the cover when closed. In the other embodiment, the cover is equipped with lifting handles. In this situation the cover plate sections are retained with a simple retaining pin inserted into the portion of the tenous which project above the cover plate sections.

BRIEF DESCRIPTION OF THE INVENTION

Figure 5:
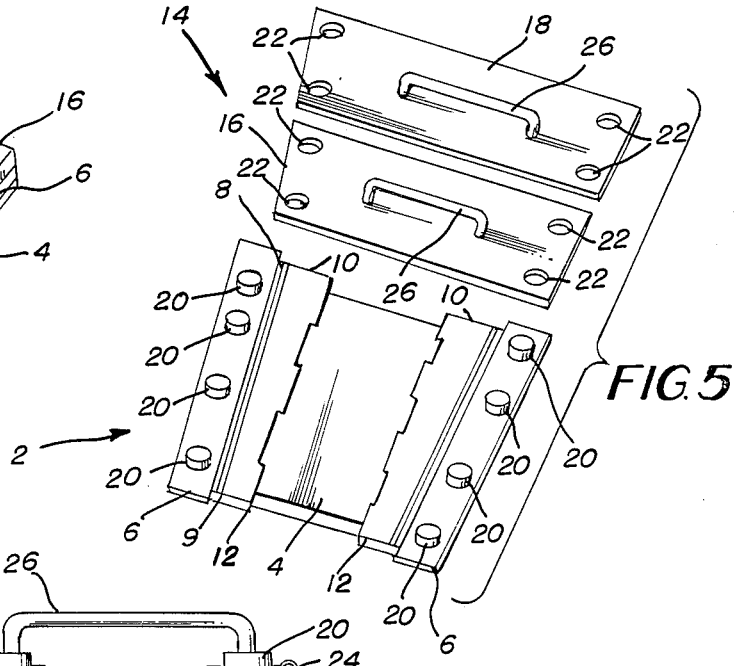
FIG. 5 is a perspective view of the cable gripping block of FIG. 4 with the top cover removed.
Figure 6:
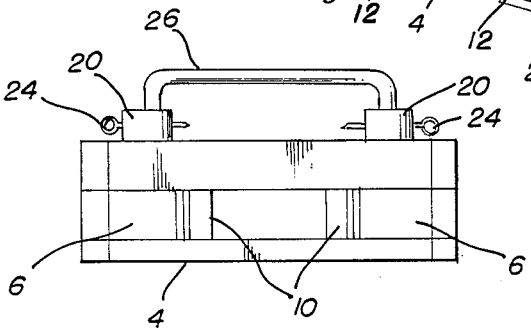
FIG. 6 is a frontal plan view of the cable gripping block of FIG. 4.

Referring to the drawings, FIG. 5 shows a typical cable gripping block 2 with a base 4 and perpendicular traction blocks 6. Each traction block 6 comprises on its inner face a slide track 8 on which one of two movable clamping blocks 10 may slide. Each slide track 8 forms an angle with the longitudinal axis of the cable (not shown) on which the traction block is intended to act, the slide tracks 9 of the two ends of the traction blocks 6 and each movable clamping block 10 having the shape of a wedge having an apex angle 14 which is equal to the angle formed between the adjacent slides 8 and the longitudinal axis of the traction blocks 6. The cover plate 14 is made of two sections 16 and 18, respectively, which form part of the present invention. In order to withstand the transverse forces generated by gripping action of the clamping blocks 10 there are tenons 20 on each traction block 6 to insert in cavities 22 in the cover plate 14. It should be emphasized that the tenons 20 are cylindrical in shape and are of a length to extend above the cover plate 14. FIG. 6 shows locking pins 24 to secure the cover plate sections 16 and 18 to the traction blocks 6.

Figure 4:
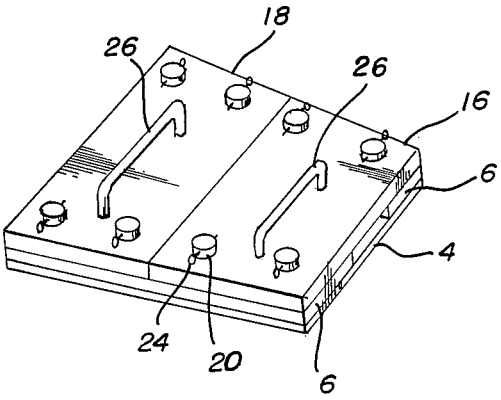
FIG. 4 is a perspective view of another cable gripping block of the invention.

FIG. 4 shows the cable gripping block 2 and cover plate sections 16 and 18, assembled. The trapezoidal shape of the cover plate sections require that section 16 at its widest parallel length be equal to the smallest parallel length of section 18, to form the larger trapezoidal shape of the cover plate. Each of the cover plate sections 16 and 18 has a lifting handle 26 to vertically lift the section off of tenons 20. The use of lifting handles 26 is necessary in field applications where other lifting means are not practical.

To use the cable gripping 2 of FIGS. 4,5 and 6, a cable (not shown) is placed between the clamping blocks 10 and by pulling on the cable, the clamping blocks 10 grip the cable as long as the cable is under tension, otherwise the cable is released by moving it or the clamping blocks 10 in the opposite direction. The cover plate 14, which is sectioned to make lifting the heavy metal sections 16 and 18, is removed by first removing locking pins 24 and then lifting it vertically off the tenons 20.

Figure 1:
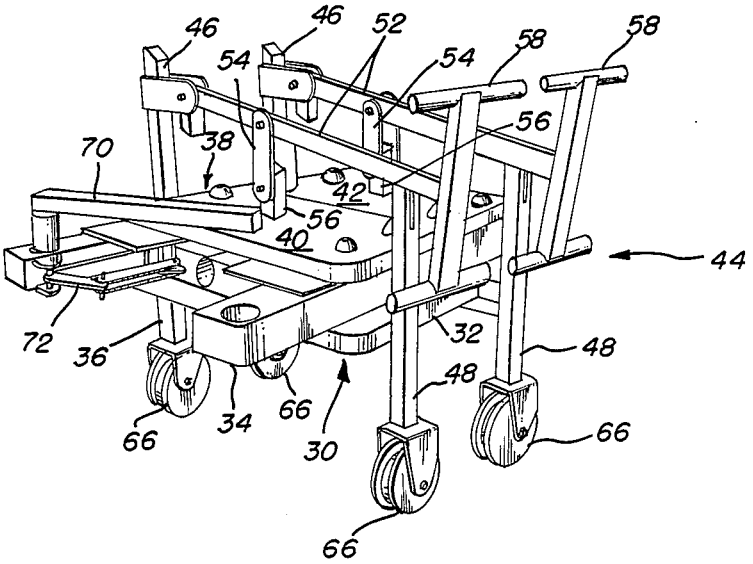
FIG. 1 is a perspective view of a cable gripping block and hold down of the invention with the cable gripping block in the closed position.
Figure 2:
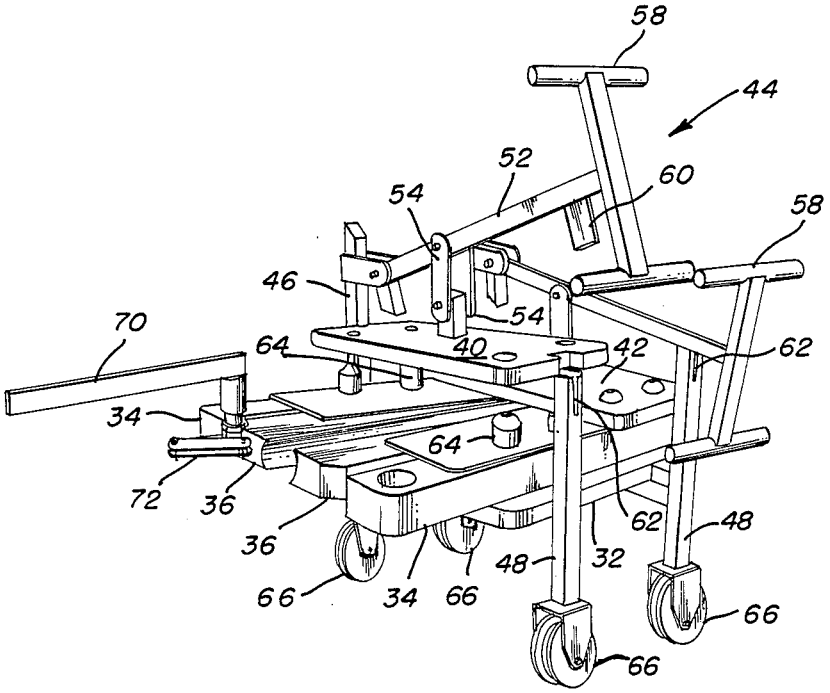
FIG. 2 is a perspective view of the cable gripping block of FIG. 1 in a partially opened position.
Figure 3:
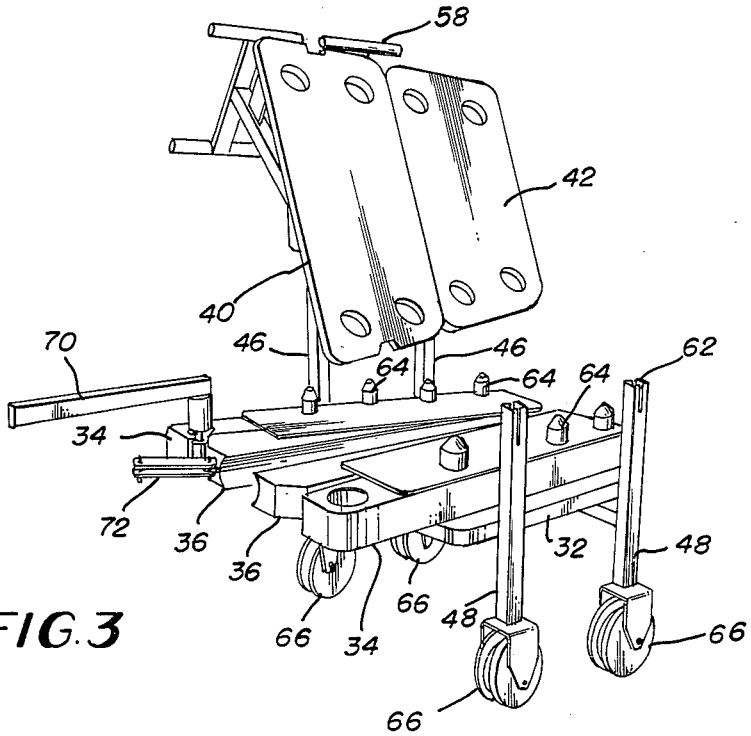
FIG. 3 is a perspective view of the cable gripping block of FIG. 2 in a fully opened position.

In the embodiment of FIGS. 1, 2 and 3 a cable gripping block 30 includes a base plate 32 with perpendicular tension blocks 34 affixed to the base plate. Each tension block 34 has slide tracks on its interface. Each slide track forms an angle with the longitudinal axis of a cable (not shown) on which the traction block is intended to act. A pair of clamping blocks 36 having slide tracks converging toward one of the two ends of the tractoin blocks 34, and each movable clamping block 36 having the shape of a wedge with an apex angle which is equal to the angle formed between the adjacent slides 36 and the longitudinal axis of the traction blocks 34. A cover plate 38 having two sections 40 and 42, respectively, close the top of the cable gripping block 30.

To absorb the transverse forces generated by the gripping action of the clamping blocks 36 the tension blocks 34 have tenons 64 with cylindrical bodies and frusto conical tops that fit in and mate with cylindrical cavities 66 in cover sections 40 and 42. In order to install the cover sections 40 and 42 on the tenons 64 a supporting frame 44 with hold down means is provided. The support frame has vertical legs 46 and 48. Pivotally mounted on leg pairs 46 and 48 are actuating arms 52 which are coupled by linkage members 54 to the cover plate sections 40 and 42 at 56. The free ends of the arms 52 having lifting member 58 for raising and lowering the cover plate sections 40 and 42. Projecting downwardly from each arm 52 is a guide member 60 which slides into slots 62 on the top of leg pairs 46 and 48 to align the cover plate sections 40 and 42 with the tenons 64. The movement of the arms 52 allow the cover plate sections 40 and 42 to move vertically downward onto the cable gripping block 30.

The supporting frame 44 has wheels 66 for moving the cable gripping block 30 from place to place. The wheels also allow the cable gripping block to move during operation and equalize tension pressure on cable for easy placement and removal of cable into and out of grips.

Turning to FIGS. 1, 2 and 3, the cable gripping block is shown in various positions with the cover plate 38 closed in FIG. 1, partially open in FIG. 2 and fully open in FIG. 3. Also shown in lever 70 and linkage 72 for moving the clamping blocks 36 longitudinally. FIG. 1 shows one end of the linkage 72 connected to the tension block 34 and the other end to movable clamping block 36. Turning the lever 70 reciprocates the clamping block 36 to either tighten or loosen the grip on a cable.

While only two embodiments of the invention have been shown it is understood that one skilled in the art may realize other embodiments. Therefore, one should consider the invention in view of the drawings, specification and claims.

I claim:

1. A cable gripping block for linear tensioning of a cable, comprising, a base plate with a pair of traction block means affixed thereon;

a pair of clamping block means movably slidable between said traction block means;

said traction block means having inner face slide surfaces between which said clamping block means slide, where each inner face slide surface forms an angle with the longitudinal axis of a cable being tensioned;

said clamping block means having slide surfaces to match with the inner face slide surfaces of said traction block means where said clamping block means has a wedge shape with an apex angle which is equal to the angle formed between the adjacent slide surfaces and the longitudinal axis of said traction block means;

a cover plate means for closing said cable gripping block and locking said clamping block means between said traction block means, said cover plate means having a trapezoidal shape;

a securing means for securing said cover plate to said traction block means including tenon means on said traction block means and matching tenon receiving cavities in said cover plate means;

said tenon means having a suitable shape for guiding said tenons onto said cavities in said cover plate means;

means for lifting said cover plate means off of said tenon means;

said cover plate means including at least two trapezoidal sections, and where one of the sections is larger than the other with the smaller section having a base length equal to the length of the smaller of the parallel lengths of the larger section;

said cover plate sections each having a pair of manual lifting handles;

said tenon means having oriface means therethrough for receiving a locking pin.

2. A cable gripping block as set forth in claim 1 in which said tenons are cylindrical in shape.

3. A cable gripping block for linear tensioning of a cable, comprising, a base plate with a pair of traction block means affixed thereon;

a pair of clamping block means movable slidable between said traction block means;

said traction block means having inner face slide surfaces between which said clamping block means slide, where each inner face slide surface forms an angle with the longitudinal axis of a cable being tensioned;

said clamping block means having slide surfaces to match with the inner face slide surfaces of said traction block means where said clamping block means has a wedge shape with an apex angle which is equal to the angle formed between the adjacent slide surfaces and the longitudinal axis of said traction block means;

a cover plate means for closing said cable gripping block and locking said clamping block means between said traction block means;

a securing means for securing said cover plate to said traction block means including tenon means on said traction block means and matching tenon receiving cavities in said cover plate means;

said tenon means having a suitable shape for guiding said tenons onto said cavities in said cover plate means;

means for lifting said cover plate means off of said tenon means;

said cover plate means including at least two sections;

said cable gripping block being supported on a portable support frame, said support frame having arcuating arm means connected to said cover plate sections for pivoting said cover plate sections individually toward and away from said cable gripping block;

said portable support frame including a first pair of legs and a second pair of legs, said actuating arms being pivotally mounted on said first pair of legs, each of said actuating arms having a downwardly projecting guide means for inserting in slot menas on said second pair of legs, a linkage means pivotally connected to said first cover plate section and to one of the actuating arms and a second linkage means pivotally connected to said second cover plate section and to the other of said actuating arms, where said cover plate sections are lifted vertically off said tenons and then pivoted to one side, and handle means on each of said actuating arms for lifting said cover plate sections;

said guide means on said actuating arms being locked in said slots on said second pair of legs by suitable locking means.

4. A cable gripping block as set forth in claim 3 in which said terms have frusto conical ends.

5. A cable gripping block as in claim 3 wherein said guide means on said actuating arms are located in said slots on said second pair of legs by including orifaces in said guide menas and said legs surround said slots to receive locking pins.

* * * * *